US010672534B1

(12) United States Patent
Abernathy

(10) Patent No.: US 10,672,534 B1
(45) Date of Patent: Jun. 2, 2020

(54) HYBRID CABLE ASSEMBLY WITH INTERNAL NYLON JACKET

(71) Applicant: Encore Wire Corporation, McKinney, TX (US)

(72) Inventor: Paul W. Abernathy, McKinney, TX (US)

(73) Assignee: Encore Wire Corporation, McKinney, TX (US)

( * ) Notice: Subject to any disclaimer, the term of this patent is extended or adjusted under 35 U.S.C. 154(b) by 0 days.

(21) Appl. No.: 16/407,001

(22) Filed: May 8, 2019

Related U.S. Application Data

(60) Provisional application No. 62/668,595, filed on May 8, 2018.

(51) Int. Cl.

| | |
|---|---|
| ***H01B 7/22*** | (2006.01) |
| ***H01B 11/22*** | (2006.01) |
| ***H01B 7/18*** | (2006.01) |
| ***H01B 7/02*** | (2006.01) |
| ***H01B 13/14*** | (2006.01) |
| ***H01B 7/32*** | (2006.01) |

(52) U.S. Cl.
CPC ..... *H01B 7/225* (2013.01); *H01B 7/0208* (2013.01); *H01B 7/0241* (2013.01); *H01B 7/182* (2013.01); *H01B 7/32* (2013.01); *H01B 11/22* (2013.01); *H01B 13/148* (2013.01)

(58) Field of Classification Search
None
See application file for complete search history.

(56) References Cited

U.S. PATENT DOCUMENTS 2,180,731 A * 11/1939 Dickinson ..... H01B 9/003 174/105 B
2,621,703 A * 12/1952 Morrison ..... H01B 7/1875 156/51
2,981,788 A * 4/1961 Bunish ..... H01B 9/028 174/115
3,120,575 A * 2/1964 Hudson ..... H01B 7/04 174/115
4,034,152 A * 7/1977 Warner ..... H01R 4/026 174/94 R
4,064,074 A * 12/1977 Ellis ..... H01B 1/00 252/506
4,129,744 A * 12/1978 Cunningham ..... H01R 4/625 174/94 R
5,220,130 A * 6/1993 Walters ..... H01B 11/1839 174/113 R
5,280,137 A * 1/1994 Ward ..... H01B 7/187 174/110 V
5,418,878 A * 5/1995 Sass ..... G02B 6/4416 385/101
5,428,187 A * 6/1995 Crane ..... H01B 7/0861 174/115

(Continued)

*Primary Examiner* — Timothy J Thompson
*Assistant Examiner* — Muhammed Azam
(74) *Attorney, Agent, or Firm* — Warren Rhoades LLP

(57) ABSTRACT

A wire cable comprising a ground conductor and an insulated conductor wherein the insulated conductor comprises a metal conductor, an insulated material surrounding the metal conductor, and a nylon jacket surrounding the insulated material. A binder surrounds the ground conductor and the insulated conductor and a jacket surrounds the binder.

16 Claims, 4 Drawing Sheets

(56) References Cited

U.S. PATENT DOCUMENTS 5,574,250 A * 11/1996 Hardie ..... H01B 11/005 174/102 R
5,705,774 A * 1/1998 Beauchamp ..... H01B 7/295 174/121 A
6,075,205 A * 6/2000 Zhang ..... H05K 9/0015 174/358
6,534,716 B1 * 3/2003 Linnell ..... H01B 11/06 174/113 C
6,686,537 B1 * 2/2004 Gareis ..... H01B 7/292 174/110 R
7,038,138 B2 * 5/2006 Laity ..... H01R 13/72 174/113 R
7,173,189 B1 * 2/2007 Hazy ..... H01B 11/04 174/110 R
7,304,245 B2 * 12/2007 Alexander ..... H01B 3/12 174/110 R
7,473,849 B2 * 1/2009 Glew ..... H01B 11/06 174/113 C
7,919,713 B2 * 4/2011 Al-Ali ..... A61B 5/14551 174/113 R
8,089,000 B2 * 1/2012 Van Der Meer ..... H01B 7/2855 174/110 R
9,960,557 B2 * 5/2018 Hayakawa ..... H01R 31/005
10,217,547 B1 * 2/2019 Kaneda ..... H01B 7/26
10,361,015 B1 * 7/2019 Skidmore
2003/0168228 A1 * 9/2003 Eichelberger ..... H01B 11/04 174/27
2006/0021786 A1 * 2/2006 Fetterolf, Sr. ..... H01B 9/003 174/113 R
2008/0060833 A1 * 3/2008 Spruell ..... H01B 13/0228 174/113 R
2009/0056975 A1 * 3/2009 Lin ..... H01B 3/443 174/113 R
2009/0200059 A1 * 8/2009 Cinquemani ..... H01B 9/025 174/113 R
2010/0078195 A1 * 4/2010 Patel ..... H01B 9/027 174/113 R
2010/0186987 A1 * 7/2010 Aitken ..... H01B 9/028 174/102 R
2010/0282491 A1 * 11/2010 Cofre Luna ..... G02B 6/4482 174/113 R
2013/0210272 A1 * 8/2013 Yuan ..... H01R 9/0515 439/581
2013/0277087 A1 * 10/2013 Hayakawa ..... B60R 16/0215 174/107
2014/0140669 A1 * 5/2014 Islam ..... G02B 6/4416 385/100
2015/0179307 A1 * 6/2015 Ranganathan ..... H01B 7/36 174/113 R
2015/0262726 A1 * 9/2015 Lee ..... H01B 1/04 174/126.2
2016/0133353 A1 * 5/2016 Liu ..... H01B 3/30 174/126.2
2017/0027090 A1 * 1/2017 Sumi ..... H05K 9/0098

* cited by examiner

HYBRID CABLE ASSEMBLY WITH INTERNAL NYLON JACKET

CROSS-REFERENCE TO RELATED APPLICATIONS

This application claims priority benefit to U.S. Provisional Application No. 62/668,595, filed May 8, 2018 and is incorporated in its entirety by reference herein.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

The present invention relates in general to electrical wire and cable, and more particularly, to the hybrid cable assemblies.

2. Description of Related Art

Underwriters Laboratories ("UL") wire and cable standards include the standards for Tray Cable ("TC") and Service Entrance cable ("SE Cable"). These standards set forth the limitations for construction and/or use of the TC and SE Cable.

Construction of TC is covered by UL 1277, and is not permitted by code to be installed outside of raceways, direct burial, and cable trays. It is not allowed to be installed in a building without being in said raceway or cable tray.

SE Cable constructions are covered by UL 854, and is designed mainly for above ground electrical cable installations to home distribution panels or panel-to-panel between multi-family dwellings. SE Cable construction is allowed for interior/building use and some exterior use without the limitations of raceways and/or cable trays. SE Cable is not permitted to be installed underground. SE Cable includes SE-R, or Type R, cable, which further requires at least four (4) conductors for inside use.

To comply with the UL standards, electrical installers installing both TC and SE Cable (or SE-R Cable) must purchase these types of wire separately and maintain these different wire types at the jobsite. Currently, multiple wire types must be purchase and maintained as a single wire type does not meet the limitations of both UL 1277 and UL 854 and thus cannot be installed for the purposes of both. There are many differences between TC and SE-R Cable are as follows: TC traditionally has a more robust jacket, but no requirement for a binder; SE-R Cable requires a fiberglass wrap beneath the jacket to add additional protection; and there are also different moisture ratings such as a cable must be rated "wet" or "dry" and pass the appropriate temperature and moisture exposure tests before it will be permitted in certain locations.

According to the prior art, two separate cable lengths of two different cable constructions were required to complete an electrical installation covering both locations, or additional infrastructure (raceways, cable trays, etc.) were required to accommodate use of TC everywhere. When using different constructions, appropriate connectors and electrical boxes are required at connection points, increasing the cost of the project. Further, time and costs are increased for each wire constructions at a job site.

Therefore, a need exists for a hybrid cable that complies with the construction and use requirements of both UL 1277 and 854. Such a hybrid cable would allow installation of a single cable in-place of either SE-R Cable or TC without switching products or requiring extra infrastructure.

BRIEF SUMMARY OF THE INVENTION

The present invention provides for a "Hybrid" SE-R/TC Cable that meets the requirements of both the UL 854 and UL 1277 standards. The "Hybrid" SE-R/TC Cable is constructed with an outer jacket suited for direct burial, and contains a fiberglass wrap under the jacket, allowing it to be used in applications not permitted before. It would be allowable for installation in both SE-R and TC applications, such as in buildings without a cable tray/raceway, underground, or in a raceway, with a wet rating and dry rating and unlimited indoor and outdoor use. The hybrid cable assembly includes one or more ground conductors, one or more insulated conductors where the insulated conductors are formed with a metal conductor surrounded by an insulated material surrounded by a nylon jacket. A binder surrounds the one or more ground conductors and the one or more insulated conductors. A jacket then surrounds the binder, forming the hybrid cable.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

DESCRIPTION OF THE PREFERRED EMBODIMENT

Figure 1:
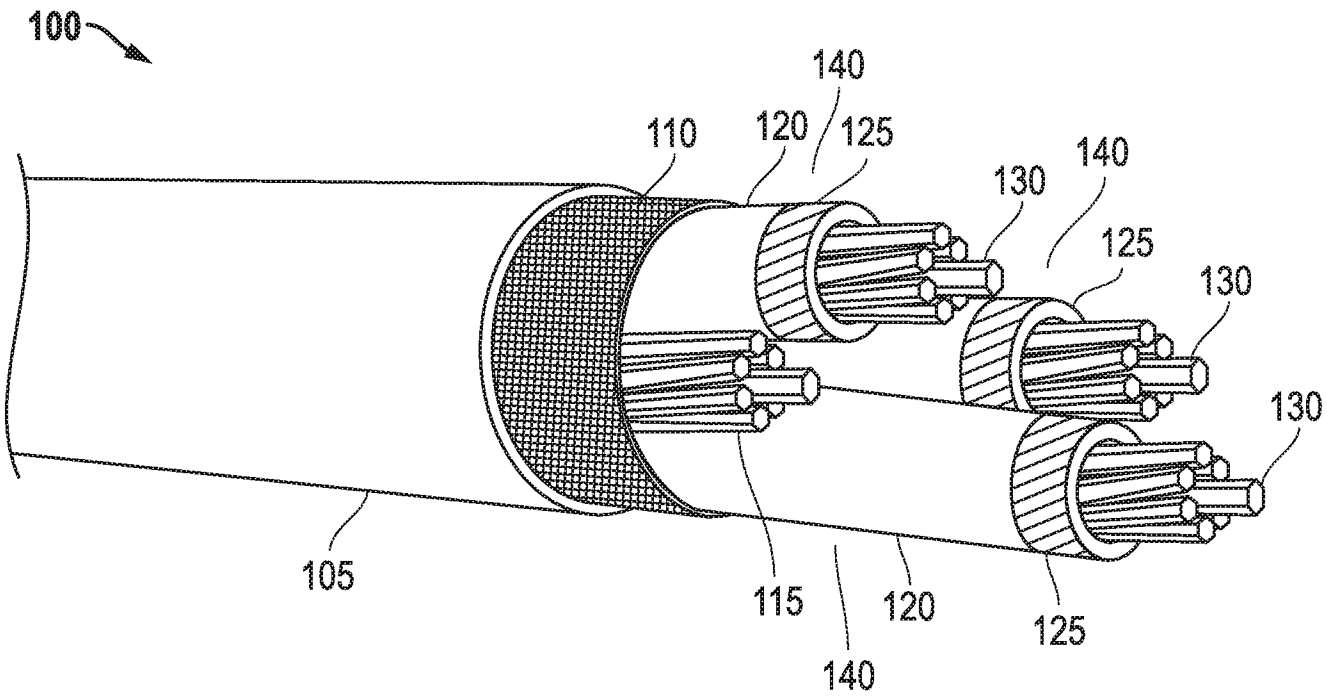
FIG. 1 is a perspective view of a hybrid cable according to a first embodiment of the invention.

The following discussion is presented to enable a person skilled in the art to make and use the present invention. The general principles described herein may be applied to embodiments and applications other than those specifically detailed below without departing from the spirit and scope of the present invention. Therefore, the present invention is not intended to be limited to the embodiments expressly shown, but is to be accorded the widest possible scope of invention consistent with the principles and features disclosed herein.

Service Entrance type R cable ("SE-R Cable") is constructed with a fiberglass tape under the outer jacket as a protective layer, and built to the standard of Type SE-R cable in UL 854, passing all associated testing. Abridged from UL 854, the construction limitations and descriptions follow:

1.9 Type SE cable is a flat or round multiple-conductor cable in sizes through 4/0 AWG copper, 300 kcmil aluminum or copper-clad aluminum and has an overall nonmetallic covering. All of the insulated conductors are of the same size. This cable complies with a cable flame test.

12.2 An insulated copper conductor shall not be smaller in size than 14 AWG. An insulated aluminum or copper-clad aluminum conductor shall not be smaller in size than 12 AWG.

12.3 . . . The insulated conductors in a Type SE cable shall not be larger than 4/0 AWG copper, 300 kcmil aluminum or copper-clad aluminum.

14.1 . . . Except for the horizontal flame test in some cases (see 39.1), and the sunlight-resistance tests required in 30.2 and 30.3, the insulated conductors in a Type SE cable shall be Type THHN, Type THWN, or Type THWN-2 as described in the Standard for Thermoplastic-Insulated Wires and Cables, UL 83, or Type XHHW, Type XHHW-2, Type RHW, Type RHW-2, Type RHH OR RHW, or Type RHH OR RHW-2 as described in the Standard for Thermoset-Insulated Wires and Cables, UL 44; [ . . . ] "USE" shall not be surface marked on conductors for Type SE cable.

17.3.1.1 The tape portion of an overall tape-and-finish covering on a Type SE cable shall be constructed as described in either (a) or (b) below:

a) A single layer of tape (see 17.3.1.2 for the method of thickness measurement). The tape shall be of any convenient width and shall be applied in either of two ways: helically without creases or folds and with an overlap of at least ¼ inch or 6 mm, or longitudinally with an overlap of at least ¼ inch or 6 mm and with a glass-fiber binder having a length of lay not exceeding 3½ inches or 89 mm. The tape shall consist of reinforced polyester, cellulose acetate, or other film tape that is at least 0.0035 inch or 0.09 mm in overall thickness. The tape is to be reinforced on one face by threads of glass fiber. The glass threads either are to be bonded to the tape without a covering over the threads or are to be bound to the tape by a film of polyester or vinyl or other material applied over the threads. The film is to be at least 0.00048 inch or 0.012 mm thick. The glass threads either are to be laid longitudinally (unidirectional) in an open pattern or are to be applied longitudinally and across the tape (bidirectional) in an open pattern or weave.

b) One or two layers of a neoprene tape that consists of an unvulcanized neoprene coating at least 0.006 inch or 0.15 mm thick (see 17.3.1.2 for the method of thickness measurement) applied to reinforcement consisting of an open, bidirectional pattern or weave of threads of glass fiber. The tape shall be of any convenient width and shall be applied helically without creases or folds. Where one serving is used, the edges of the tape shall be overlapped at least ¼ inch or 6 mm. Where two servings are used and they are applied in opposite directions, the edges of the tape in each serving shall be overlapped at least ¼ inch or 6 mm. Where two servings are used and they are applied in the same direction, 1) The edges of the tape in each serving shall be abutted or shall be overlapped at least ¼ inch or 6 mm, and 2) The abutted or overlapped edges of the second tape shall be located approximately over the center of the tape in the underlying serving.

17.3.2.1 The finish portion of an overall tape-and-finish covering on a Type SE cable shall be of a 75° C. (167° F.) Class 43 PVC (no oil resistance) having physical properties complying with Table 50.182 of UL 1581 where specimens prepared from samples of the PVC taken from the finished cable are tested as referenced (UL 1581) in the last sentence of 17.2.1.1.

17.3.2.2 The average thickness of the PVC removed from the finished cable shall not be less than 0.030 inch or 0.76 mm. The minimum thickness at any point of the PVC removed from the finished cable shall not be less than 0.025 inch or 0.64 mm . . .

20.1 A vertical specimen of finished Type SE cable shall comply with the Cable Flame Test, Section 1061 of UL 1581.

Tray cable is constructed with an outer jacket suited for direct burial, and is built to the standard of UL 1277, passing all associated tests. Abridged from UL 1277, selected defining construction limitations and descriptions follow:

1.1 These requirements cover electrical power and control cables consisting of either two or more current-carrying copper, aluminum, or copper-clad aluminum circuit conductors, or one or more pairs of thermocouple-extension wires.

6.2 A copper conductor shall not be smaller than 18 AWG and shall not be larger than 1000 kcmil. An aluminum or copper-clad aluminum conductor shall not be smaller than 12 AWG and shall not be larger than 1000 kcmil.

8.1 The cable may contain one or more grounding conductors. Each grounding conductor that is provided shall be of copper, aluminum, or copper-clad aluminum and shall not be smaller than indicated in the applicable Table . . .

11.3.1 The entire cable assembly, or any group of conductors (with or without one or more optical-fiber members included in the group), or several such groups within the cable may be enclosed in a binder consisting of a shield (see 11.4.1-11.4.3) or of a braid, tape, or other unspecified means. An individual group or several groups may be enclosed in a thin binder jacket that is of the same temperature rating as the overall cable jacket. The thicknesses of a binder jacket (extruded binder) shall not be less than indicated in Table 11.2 when measured as described in 11.3.2 and 11.3.3.

12.1.1 A jacket shall be extruded directly over the flat or round assembly of conductors and any optical-fiber members, fillers, binders, and the like. The assembly shall be completely covered and well centered in the jacket. The jacket shall not have any defects (bubbles, open spots, rips, tears, cuts, or foreign material) that are visible with normal or corrected vision without magnification. The absence of the defects mentioned in the previous sentence is acceptable evidence of the integrity of the jacket—that is, that the jacket constitutes the gas/vapor-tight continuous sheath mentioned in 1.3. The outer surface of the overall jacket may show impressions of the underlying assembly but shall not show depressions caused by unfilled spaces beneath the overall jacket . . .

15.1 The overall jacket on and the insulation and any other nonmetallic material in the finished cable shall not exhibit damage that reaches the upper end of any sample after two sets of samples of a cable containing nine insulated 12 AWG conductors are separately installed in a vertical ladder type of cable tray and subjected to 20 min of flame as described under "UL Flame Exposure" or "FT4/IEEE 1202 Type of Flame Exposure" in the Standard Vertical-Tray Fire-Propagation and Smoke-Release Test for Electrical and Optical-Fiber Cables, UL 1685. Smoke measurements are not applicable . . .

20.1 Finished cable whose overall jacket is marked [see 29.1(h)] to indicate that the cable is for use in sunlight is to be considered acceptable for sunlight-resistant use if the ratio of the average tensile strength and ultimate elongation of five conditioned specimens of the overall jacket to the average tensile strength and ultimate elongation of five unconditioned specimens of the overall jacket is 0.80 or more when the jacket from the finished cable is conditioned and tested as outlined in Section 1200 of UL 1581 using 720 h of carbon-arc exposure or xenon-arc exposure.

The "Hybrid" SE-R/TC Cable meets the requirements of both the UL 854 and UL 1277 standards. The "Hybrid" SE-R/TC Cable is constructed with an outer jacket suited for direct burial, and contain a fiberglass wrap under the jacket, allowing it to be used in applications not permitted before. It would be allowable for installation in both SE-R and TC applications, such as in buildings without a cable tray/raceway, underground, or in a raceway, with a wet rating and dry rating and unlimited indoor and outdoor use.

In one embodiment, the "Hybrid" SE-R/TC Cable is applicable for the current sizes of SE-R cable, however, a wide variety of sizes may be implemented without detracting from the spirit of the invention, including but not limited to all of the sizes of the TC. The "Hybrid" SE-R/TC Cable is as follows:

| Requirement | SE (UL 854) | TC (UL 1277) | Notes |
|---|---|---|---|
| Thickness | Table 17.2 | Table 12.3 | Thickest jacket requirement will be applicable. |
| Binder | Section 17.3.1 | Table 11.2 | Thickest binder requirement will be applicable, lay length <= 3.5", Glass fiber reinforced tape only. |
| Oil Resistance | X | Table 12.2 | Rating for 75° C. jacket - 65% tensile and elongation retention after test. |
| Continuity | Section 28 | Section 13 | Equivalent standards. Each conductor will be tested in series with a lamp or bell/buzzer |
| Dielectric Voltage withstand | Section 29 (Table 29.1) | Section 14 (Table 14.1) | Both Standards have similar tests with different operating voltages and ramp speeds. The cable would be pass both test methods. |
| Flame Testing | Sections 20, 31 | Sections 15 | Two sets of both 9-conductor 12AWG, and 2-conductor with ground 6AWG cable constructions would need to pass the "FT4/IEEE 1202 Type of Flame Exposure" test specified in UL 1685 (smoke measurements not applicable) |
| Smoke Testing | X | Section 16 | Optional testing under TC for a "-LS" marking |
| Cold Bend/Flexibility test | Section 21 | Section 17 | Cable samples must pass tests specified in both UL 1277 section 17, and UL 1581 Section 583, as method, and mandrel type/size vary. |
| Cold Impact | X | Section 18 | Cables pass when subjected to the test method specified in UL 1581 Section 593. |
| Crushing Test | X | Section 19 | Cables must pass when subjected to test method specified in UL 1277 Sections 19.1-19.6 for a "direct burial" marking |
| Sunlight Resistance | Section 30 | Section 20 | Product will pass test specified in UL 1581, Section 1700 (720 hour exposure) |
| Deformation | X | Section 21 | When subjected to the test in UL 1581, Section 560, values will pass expectations laid out in UL 1277, Table 21.1 |
| Heat Shock | X | Section 22 | When subjected to the test in UL 1277, Section 22, values will pass expectations laid out in Table 22.1 |
| Impact Test | X | Section 23 | Values will pass test and expectations laid out in UL 1277 Section 23 & 24 to receive the "-ER" optional marking. |
| Identification Requirements | Section 35 | Section 29 | Marking expectations will change with number of optional markings. |
| Low Temperature pulling through joist | Section 32 | X | Jacket must survive low-temperature test in UL 854, section 32 |

-continued

| Requirement | SE (UL 854) | TC (UL 1277) | Notes |
|---|---|---|---|
| Overload Testing | Section 27 | X | Cable shall not flame/rupture during test specified in UL 854, Section 27 |
| Size constraints | Section 1.9 | Section 6.2 | Inners Limited to 14-4/0 AWG Copper, 12AWG-300kcmi1 aluminum by UL 854 (range is wider in UL 1277). |
| Lay Length | Table 15.4 | Table 11.1 | Lay length expectations are equivalent for the range of size/conductors specified, based on cable diameter. |
| Tensile & Elongation | Section 17.3.2.1 | Table 12.1 | Both Cables are held to the standards of PVC jacket material specified in UL 1581, Table 50.182. |
| Printing Durability | X | Section 25 | Meets expectations of UL 1581, Section 1690. |

The specifications above are determined by the current expectations of the applicable UL standards. If the standards are changed or updated, as they often are, the definition and scope of the Hybrid cable construction would change with them to remain compliant with all applicable codes.

Referring now to FIG. 1, one embodiment of a hybrid TC/SE-R Cable is disclosed. A hybrid TC/SE-R cable 100 is shown. The cable 100 includes one or more ground (or bare) conductors 115 and one or more insulated conductors 140. The one or more ground conductors 115, in one embodiment, include stranded copper conductors. Each insulated conductor 140 includes a metal conductor 130. The metal conductor 130 includes a stranded copper conductor. Each insulated conductor 140 includes an insulation material 125 surrounding the metal conductor 130. The insulation material 125 may include a wide variety of materials without detracting from the spirit of the invention including Polyvinyl chloride (PVC) insulation and cross-linked polyethylene (XLPE) insulation. The insulation material 125 may be surrounded by a Nylon conductor jacket 120. Both the insulated material 125 and the Nylon conductor jacket 120 (if included) are extruded onto the metal conductor 130 through processes known to those skilled in the art. In one embodiment, the PVC insulation 125 and Nylon conductor jacket 120 comply with standard UL83 Types THHN, THWN, or THWN-2 construction requirements. In another embodiment the XLPE insulation 125 complies with standard UL44 Types XHHW, XHHW-2, RHW, RHW-2, "RHH or RHW" or "RHH or RHW-2" construction requirements. The one or more ground conductors 115 and the metal conductors 130 of the insulated conductors 140 may be of the same size or different sizes.

The one or more ground conductors 115 and the one or more insulated conductors 140 are laid together. The one or more ground conductors 115 and the one or more insulated conductors 140 may be helically cabled together or cabled together in a parallel pattern. A binder 110 is wrapped around the one or more ground conductors 115 and the one or more insulated conductors 140. The binder 110 may be helically wrapped around the one or more ground conductors 115 and the one or more insulated conductors 140. The binder 110 may be formed from a wide variety of material including, but not limited to, reinforced polyester, cellulose acetate, or other polymeric (or film) tape reinforced by glass fiber. In one embodiment, the binder 110 is required by code to be at least 0.0035 inches or 0.09 mm thick. An outer jacket 105 is extruded over the binder 110, the one or more ground conductors 115, and the one or more insulated conductors 140. The outer jacket 105 may be formed from a variety of materials, including PVC. In one embodiment, the PVC outer jacket 105 meets at least a 75° C. wet/dry rating or better.

Figure 2:
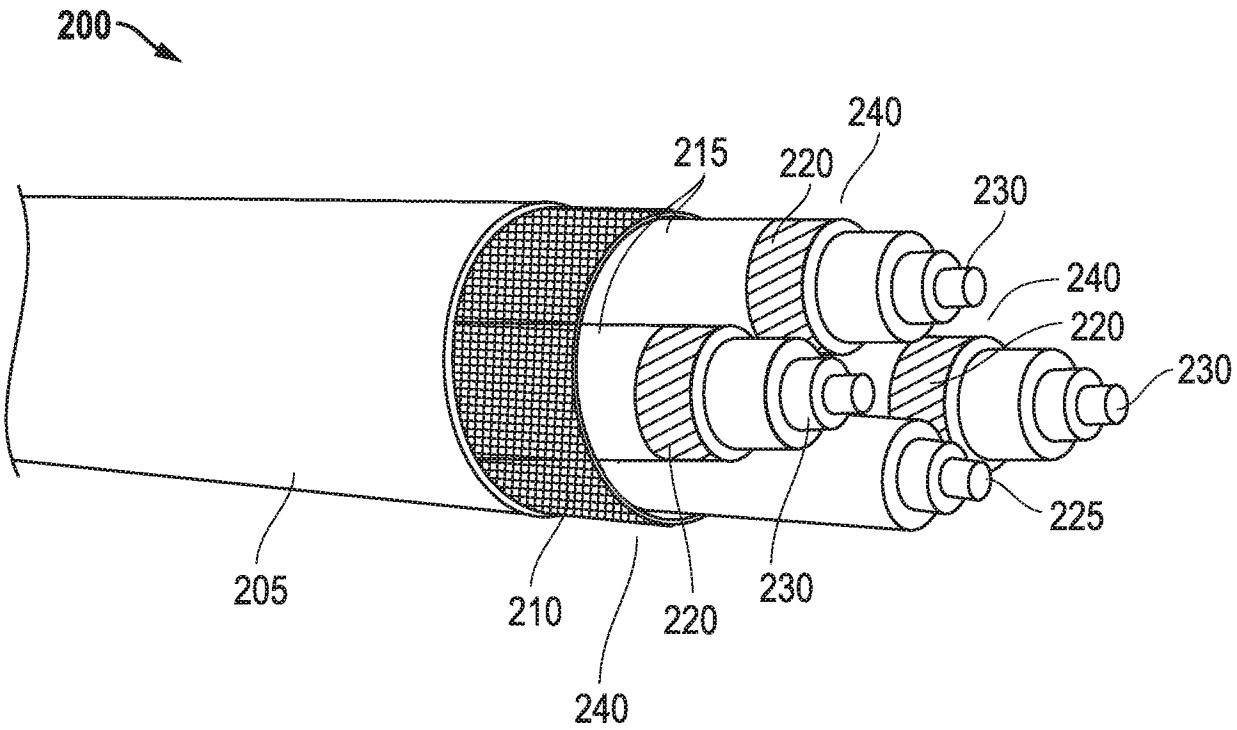
FIG. 2 is a perspective view of a hybrid cable according to a second embodiment of the invention.

Referring now to FIG. 2, another embodiment of a hybrid TC/SE-R Cable is disclosed. A hybrid TC/SE-R cable 200 is shown. The cable 200 includes one or more ground (or bare) conductors 225 and one or more insulated conductors 240. Each insulated conductor 240 includes a metal conductor 230. The one or more ground conductors 225 and the metal conductor 230, in one embodiment, include a wide variety of materials including, but not limited to, an aluminum conductor and a compact stranded conductor AA-8000 series. The metal conductors 230 of the insulated conductors 240 may be of the same size or different sizes. Each insulated conductor 240 includes an insulation material 220 surrounding the metal conductor 230. The insulation material 220 may include a wide variety of materials without detracting from the spirit of the invention including PVC insulation and XLPE insulation. The insulation material 220 may be surrounded by a Nylon conductor jacket 215. Both the insulated material 220 and the Nylon conductor jacket 215 (if included) are extruded onto the metal conductor 230 through processes known to those skilled in the art. In one embodiment, the PVC insulation 220 and Nylon conductor jacket 215 comply with standard UL83 Types THHN, THWN, or THWN-2 construction requirements. In another embodiment the XLPE insulation 220 complies with standard UL44 Types XHHW, XHHW-2, RHW, RHW-2, "RHH or RHW" or "RHH or RHW-2" construction requirements. The one or more ground conductors 225 and the metal conductors 230 of the insulated conductors 240 may be of the same size or different sizes.

The one or more ground conductors 225 and the one or more insulated conductors 240 are laid together. The one or more ground conductors 225 and the one or more insulated conductors 240 may be helically cabled together or cabled together in a parallel pattern. A binder 210 is wrapped around the one or more ground conductors 225 and the one or more insulated conductors 240. The binder 210 may be helically wrapped around the one or more ground conductors 225 and the one or more insulated conductors 240. The binder 210 may be formed from a wide variety of material including, but not limited to, reinforced polyester, cellulose acetate, or other polymeric (or film) tape reinforced by glass fiber. In one embodiment, the binder 210 is required by code to be at least 0.0035 inches or 0.09 mm thick. An outer jacket 205 is extruded over the binder 210, the one or more ground conductors 225, and the one or more insulated conductors 240. The outer jacket 205 may be formed from a variety of materials, including PVC. In one embodiment, the PVC outer jacket 205 meets at least a 75° C. wet/dry rating or better.

Figure 3:
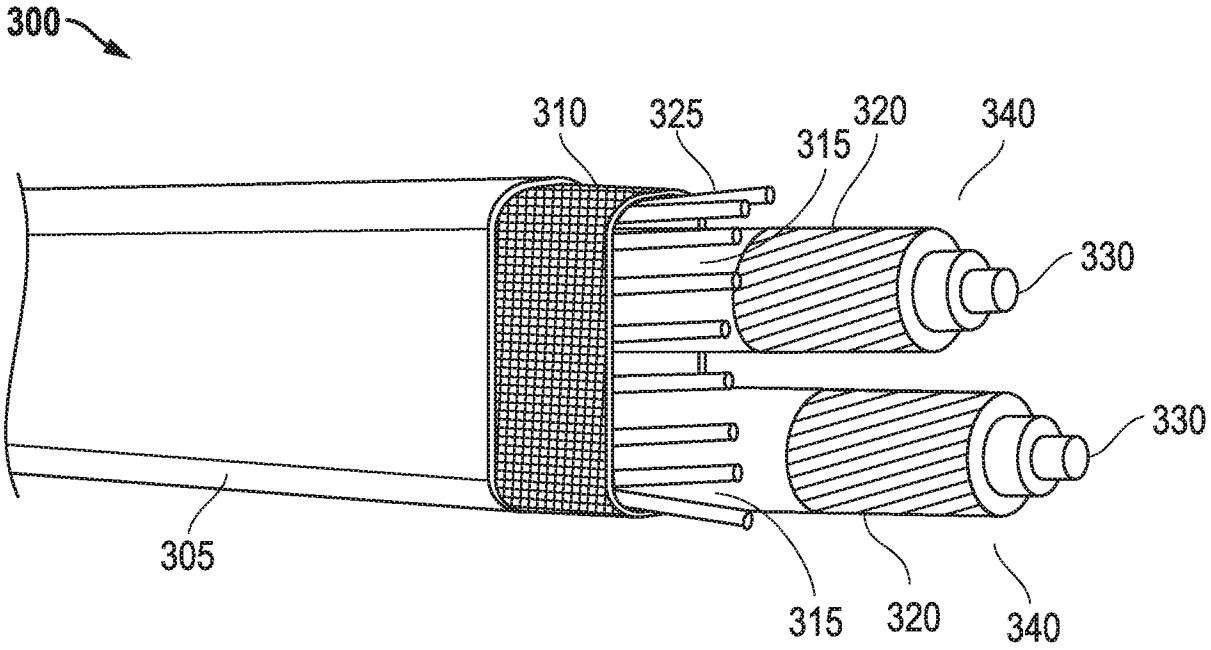
FIG. 3 is a perspective view of a hybrid cable according to a third embodiment of the invention.

Referring now to FIG. 3, another embodiment of a hybrid TC/SE-R Cable is disclosed. A hybrid TC/SE-R cable 300 is shown. The cable 300 includes one or more ground (or bare) conductors 325 and one or more insulated conductors 340. Each insulated conductor 340 includes a metal conductor 330. The one or more ground conductors 325 and the metal conductor 330 include a wide variety of materials including, but not limited to, an aluminum conductor and a compact stranded conductor AA-8000 series. Each insulated conductor 340 includes an insulation material 320 surrounding the metal conductor 330. The insulation material 320 may include a wide variety of materials without detracting from the spirit of the invention including PVC insulation and XLPE insulation. The insulation material 320 may be surrounded by a Nylon conductor jacket 315. Both the insulated material 320 and the Nylon conductor jacket 315 (if included) are extruded onto the metal conductor 330 through processes known to those skilled in the art. In one embodiment, the PVC insulation 320 and Nylon conductor jacket 315 comply with standard UL83 Types THHN, THWN, or THWN-2 construction requirements. In another embodiment the XLPE insulation 320 complies with standard UL44 Types XHHW, XHHW-2, RHW, RHW-2, "RHH or RHW" or "RHH or RHW-2" construction requirements. The one or more ground conductors 325 and the metal conductors 330 of the insulated conductors 340 may be of the same size or different sizes.

The one or more ground conductors 325 and the one or more insulated conductors 340 are laid together. In one embodiment, the one or more ground conductors 325 and the one or more insulated conductors 340 may be cabled together in a parallel pattern. In another embodiment, the one or more insulated conductors 340 are helically cable together and then the one or more ground conductors 325 are helically cabled around the helically cabled insulated conductors 340. A binder 310 is wrapped around the one or more ground conductors 325 and the one or more insulated conductors 340. The binder 310 may be helically wrapped around the one or more ground conductors 325 and the one or more insulated conductors 340. The binder 310 may be formed from a wide variety of material including, but not limited to, reinforced polyester, cellulose acetate, or other polymeric (or film) tape reinforced by glass fiber. In one embodiment, the binder 310 is required by code to be at least 0.0035 inches or 0.09 mm thick. An outer jacket 305 is extruded over the binder 310, the one or more ground conductors 325, and the one or more insulated conductors 340. The outer jacket 305 may be formed from a variety of materials, including PVC. In one embodiment, the PVC outer jacket 305 meets at least a 75° C. wet/dry rating or better.

Figure 4:
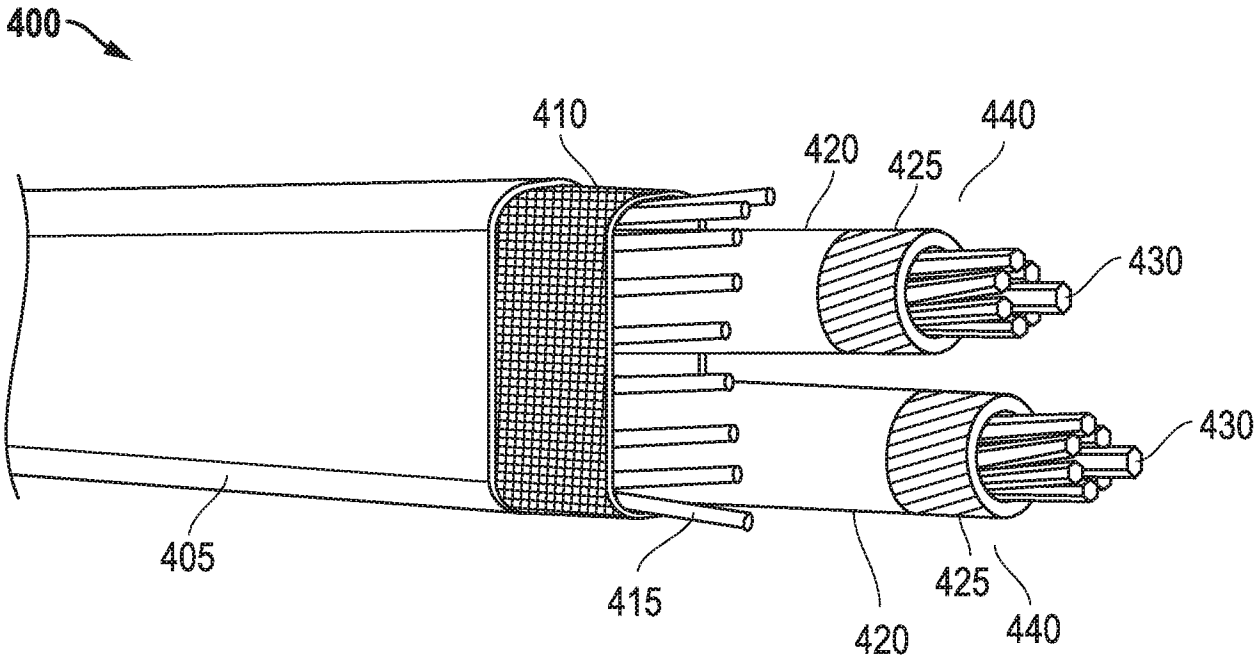
FIG. 4 is a perspective view of a hybrid cable according to a fourth embodiment of the invention.

Referring now to FIG. 4, another embodiment of a hybrid TC/SE-R Cable is disclosed. A hybrid TC/SE-R cable 400 is shown. The cable 400 includes one or more ground conductors 415 and one or more insulated conductors 440. Each insulated conductor 440 includes a metal conductor 430. The metal conductor 430 includes a wide variety of materials including, but not limited to, stranded copper conductors. Each insulated conductor 440 includes an insulation material 425 surrounding the metal conductor 430. The insulation material 425 may include a wide variety of materials without detracting from the spirit of the invention including PVC insulation and XLPE insulation. The insulation material 425 may be surrounded by a Nylon conductor jacket 420. Both the insulated material 425 and the Nylon conductor jacket 420 (if included) are extruded onto the metal conductor 430 through processes known to those skilled in the art. In one embodiment, the PVC insulation 425 and Nylon conductor jacket 420 comply with standard UL83 Types THHN, THWN, or THWN-2 construction requirements. In another embodiment the XLPE insulation 425 complies with standard UL44 Types XHHW, XHHW-2, RHW, RHW-2, "RHH or RHW" or "RHH or RHW-2" construction requirements. The one or more ground conductors 415 and the metal conductors 430 of the insulated conductors 440 may be of the same size or different sizes.

The one or more ground conductors 415 and the one or more insulated conductors 440 are laid together. In one embodiment, the one or more ground conductors 415 and the one or more insulated conductors 440 may be cabled together in a parallel pattern. In another embodiment, the one or more insulated conductors 440 are helically cable together and then the one or more ground conductors 415 are helically cabled around the helically cabled insulated conductors 440. A binder 410 is wrapped around the one or more ground conductors 415 and the one or more insulated conductors 440. The binder 410 may be helically wrapped around the one or more ground conductors 415 and the one or more insulated conductors 440. The binder 410 may be formed from a wide variety of material including, but not limited to, reinforced polyester, cellulose acetate, or other polymeric (or film) tape reinforced by glass fiber. In one embodiment, the binder 410 is required by code to be at least 0.0035 inches or 0.09 mm thick. An outer jacket 405 is extruded over the binder 410, the one or more ground conductors 415, and the one or more insulated conductors 440. The outer jacket 405 may be formed from a variety of materials, including PVC. In one embodiment, the PVC outer jacket 405 meets at least a 75° C. wet/dry rating or better.

The ground conductors (115, 225, 325, 415) and the metal conductors (130, 230, 330, 340) may be made from a wide variety of materials without detracting from the spirit of the invention including, but not limited to, copper, aluminum, or copper-clad aluminum. The one or more ground conductors (115, 225, 325, 415) in one embodiment may be limited in size as follows: Copper conductors between 14 AWG and 4/0 AWG and Aluminum and copper-clad aluminum between 12 AWG and 300 kcmil. Additionally, the thickness of the outer PVC jacket (105, 205, 305, 405) for each size will be compliant with the thickest requirements, Table 12.3 in UL 1277:

TABLE 12.3

| Thicknesses[a] of overall jacket | | | | | |
|---|---|---|---|---|---|
| Calculated diameter of round assembly under jacket or calculated length of major axis of flat assembly under jacket | | Minimum average thickness | | Minimum thickness at any point | |
| inch | mm | mils | mm | mils | ram |
| 0-0.425 | 0-10.80 | 45 | 1.14 | 36 | 0.91 |
| Over 0.425 but not over 0.700 | Over 10.80 but not over 17.78 | 60 | 1.52 | 46 | 1.22 |
| Over 0.700 but not over 1.500 | Over 17.78 but not over 38.10 | 80 | 2.03 | 64 | 1.63 |
| Over 1.500 but not over 2.500 | Over 38.10 but not over 63.50 | 110 | 2.78 | 88 | 2.24 |
| Over 2.500 | Over 63.50 | 140 | 3.56 | 112 | 2.84 |

[a]Thciknesses other than those covered in this table are acceptable if the finished cable employing a jacket with the other thicknesses performs acceptably in the tests described in this standard. Crushing, impact, abrasion, and other tests may be part of the evaluation.

Although the invention is described herein with reference to specific embodiments, various modifications and changes can be made without departing from the scope of the invention as set forth in the claims below. Accordingly, the specification and figures are to be regarded in an illustrative rather than a restrictive sense, and all such modifications are intended to be included within the scope of the invention. Any benefits, advantages, or solutions to problems that are described herein with regard to specific embodiments are not intended to be construed as a critical, required, or essential feature or element of any or all the claims.

From time-to-time, the invention is described herein in terms of these example embodiments. Description in terms of these embodiments is provided to allow the various features and embodiments of the invention to be portrayed in the context of an exemplary application. After reading this description, it will become apparent to one of ordinary skill in the art how the invention can be implemented in different and alternative environments. Unless defined otherwise, all technical and scientific terms used herein have the same meaning as is commonly understood by one of ordinary skill in the art to which this invention belongs.

The preceding discussion is presented to enable a person skilled in the art to make and use the invention. The general principles described herein may be applied to embodiments and applications other than those detailed below without departing from the spirit and scope of the invention as defined by the appended claims. The invention is not intended to be limited to the embodiments shown, but is to be accorded the widest scope consistent with the principles and features disclosed herein.

In addition, while a particular feature of the invention may have been disclosed with respect to only one of several embodiments, such feature may be combined with one or more other features of the other embodiments as may be desired. It is therefore, contemplated that the claims will cover any such modifications or embodiments that fall within the true scope of the invention.

The various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one", "one or more" or the like; and adjectives such as "conventional", "traditional", "normal", "standard", "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more", "at least", "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

Unless stated otherwise, terms such as "first" and "second" are used to arbitrarily distinguish between the elements such terms describe. Thus, these terms are not necessarily intended to indicate temporal or other prioritization of such elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

All publications and patents mentioned in the above specification are herein incorporated by reference. Various modifications and variations of the described method and system of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are obvious to those skilled in the field or any related fields are intended to be within the scope of the following claims.

What is claimed is:

1. A wire cable, the wire cable comprising:

a ground conductor, wherein the ground conductor is a copper-clad aluminum conductor;

an insulated conductor, wherein the insulated conductor comprises:

a metal conductor, wherein the metal conductor is a copper-clad aluminum conductor;

an insulated material surrounding the metal conductor; and a nylon jacket surrounding the insulated material;

a binder surrounding the ground conductor and the insulated conductor; and a jacket surrounding the binder.

2. The wire cable of claim 1, wherein the ground conductor comprises two ground conductors.

3. The wire cable of claim 1, wherein the ground conductor is a stranded ground conductor.

4. The wire cable of claim 1, wherein the metal conductor and the ground conductor are compact stranded conductors.

5. The wire cable of claim 1, wherein the insulated material of the insulated conductor is polyvinyl chloride.

6. The wire cable of claim 1, wherein the insulated material of the insulated conductor is cross-linked polyethylene.

7. The wire cable of claim 1, wherein the insulated material of the insulated conductor is extruded on to the metal conductor.

8. The wire cable of claim 1, wherein the metal conductor and the ground conductor are different sizes.

9. The wire cable of claim 1, wherein the insulated conductor and the ground conductor are helically cabled together.

10. The wire cable of claim 1, wherein the insulated conductor and the ground conductor are cabled together in parallel.

11. The wire cable of claim 1, wherein the binder is helically surrounding the insulated conductor and the ground conductor.

12. The wire cable of claim 1, wherein the insulated conductor comprises two insulated conductors.

13. The wire cable of claim 12, wherein the two insulated conductors are helically cabled together.

14. The wire cable of claim 13, wherein the ground conductor is helically cabled around the two helically cabled insulated conductors.

15. The wire cable of claim 1, wherein the outer jacket is extruded over the binder, the insulated conductor, and the ground conductor.

16. The wire cable of claim 1, wherein the binder comprises a polymeric tape reinforced by glass fiber.

* * * * *